US011199800B2

(12) United States Patent
Yamaguchi et al.

(10) Patent No.: US 11,199,800 B2
(45) Date of Patent: Dec. 14, 2021

(54) IMAGE FORMING APPARATUS

(71) Applicant: FUJIFILM Business Innovation Corp., Tokyo (JP)

(72) Inventors: Eiichiro Yamaguchi, Kanagawa (JP); Yoichi Yamakawa, Kanagawa (JP); Keita Mizukoshi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/535,827

(22) Filed: Aug. 8, 2019

(65) Prior Publication Data

US 2020/0264545 A1 Aug. 20, 2020

(30) Foreign Application Priority Data

Feb. 15, 2019 (JP) ..... JP2019-024971

(51) Int. Cl.
*G03G 15/00* (2006.01)

(52) U.S. Cl.
CPC ..... *G03G 15/5062* (2013.01); *G03G 15/6567* (2013.01)

(58) Field of Classification Search
CPC ..... B65H 2220/01; B65H 2220/03; G03G 15/70; G03G 15/55
See application file for complete search history.

(56) References Cited

U.S. PATENT DOCUMENTS

2011/0044715 A1* 2/2011 Ogata ..... G03G 15/6552 399/81
2011/0217050 A1* 9/2011 Harada ..... G03G 15/00 399/9
2013/0033724 A1* 2/2013 Nonaka ..... G03G 15/5029 358/1.15
2016/0282792 A1* 9/2016 Nakata ..... G03G 15/602

FOREIGN PATENT DOCUMENTS

JP 6-183601 A 7/1994
JP 2003-176050 A 6/2003
JP 2007-232952 A 9/2007

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

An image forming apparatus includes a recording material loading unit, a transport unit, a detector, and a controller. A recording material is loaded in the recording material loading unit. The transport unit transports the recording material from the recording material loading unit to an image forming unit that forms an image on the recording material. The detector detects a transport state of the transported recording material on a way from the recording material loading unit to the image forming unit. The controller performs control to change a position in which a user is prompted to check the transport state of the recording material and display a countermeasure method, based on a determination criterion that is determined according to (i) the transport state of the recording material detected by the detector and (ii) recording material information on the recording material.

10 Claims, 11 Drawing Sheets

| SHEET TYPE | DETECTION LEVEL |
|---|---|
| PLAIN PAPER | 1 |
| THICK PAPER 1 | 2 |
| THICK PAPER 2 | 4 |
| LABEL PAPER | 5 |
| COATED PAPER | 3 |
| OHP | EXCLUDED |
| OTHERS | EXCLUDED |

FIG. 5A

| SHEET WIDTH | DETECTION LEVEL |
|---|---|
| ≦210mm(A4 SEF OR LESS ) | 3 |
| 211～257mm(A4 SEF～B4 SEF) | 2 |
| 258～297mm(B4 SEF～A3 SEF) | 1 |
| ≧298mm(A3 SEF OR MORE ) | 4 |

FIG. 5B

| SHEET TYPE | DETECTION LEVEL |
|---|---|
| PLAIN PAPER | 1 |
| THICK PAPER 1 | 2 |
| THICK PAPER 2 | 4 |
| LABEL PAPER | 5 |
| COATED PAPER | 3 |
| OHP | EXCLUDED |
| OTHERS | EXCLUDED |

FIG. 5C

| SHEET WIDTH | SHEET TYPE | | | | | |
|---|---|---|---|---|---|---|
| | 1 | 2 | 3 | 4 | 5 | EXCLUDED |
| 1 | A | A | A | B | B | NO FUNCTION |
| 2 | A | B | B | C | C | NO FUNCTION |
| 3 | A | B | C | C | C | NO FUNCTION |
| 4 | B | C | C | C | C | NO FUNCTION |

FIG. 6

| | ≦210mm | 211～257mm | 258～297mm | ≧298mm |
|---|---|---|---|---|
| PLAIN PAPER | A | A | A | B |
| THICK PAPER 1 | B | B | A | C |
| THICK PAPER 2 | C | C | B | C |
| LABEL PAPER | C | C | B | C |
| COATED PAPER | C | B | A | C |
| OHP | NO FUNCTION | NO FUNCTION | NO FUNCTION | NO FUNCTION |
| OTHERS | NO FUNCTION | NO FUNCTION | NO FUNCTION | NO FUNCTION |

IMAGE FORMING APPARATUS

CROSS-REFERENCE TO RELATED APPLICATIONS

This application is based on and claims priority under 35 USC 119 from Japanese Patent Application No. 2019-024971 filed Feb. 15, 2019.

BACKGROUND

1. Technical Field

The present disclosure relates to an image forming apparatus.

2. Related Art

The following sheet abnormal transport detection apparatus has been known. That is, the sheet abnormal transport detection apparatus includes at least three sheet detection sensors arranged along a straight line in a direction perpendicular to a transport direction of a sheet transported from a sheet feeding unit, a skew detector configured to detect skew of the sheet by (i) receiving detection outputs of sheet detection sensors on both ends of the straight line among the sheet detection sensors and (ii) obtaining a difference between times at which a leading end of the sheet reaches the sheet detection sensors, and a sheet crease detector configured to detect a sheet crease by checking whether a combination pattern of risings of the detection outputs matches a preset combination pattern during the sheet crease (JP-A-6-183601).

The following sheet separation and transport apparatus has also been known. The sheet separation and transport apparatus includes a feed unit configured to come into contact with a sheet bundle and rotate in a transport direction of sheets, a separation unit configured to abut against the feed unit and separate the sheets from the sheet bundle one by one by a frictional force that acts in a direction opposite to the transport direction as the feed unit rotates, and a detector configured to detect positions of leading ends of the transported sheets. The sheet separation and transport apparatus further includes a measurement unit configured to measure a time from when the sheet starts from a separation and transport start position to when the sheet reaches a position where the detector detects the leading end of the sheet, a comparison unit configured to compare the measured time of the measurement unit with an optional specified time, and a notification unit configured to notify an instruction to clean the feed unit according to a comparison result of the comparison unit (JP-A-2003-176050).

SUMMARY

Aspects of non-limiting embodiments of the present disclosure relate to an image forming apparatus for notifying a user of an occurrence position of an assumed malfunction and prompting the user to take a countermeasure, according to a detected skew degree and the continuity of skew.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a recording material loading unit in which a recording material is loaded; a transport unit configured to transport the recording material from the recording material loading unit to an image forming unit configured to form an image on the recording material; a detector configured to detect a transport state of the transported recording material on a way from the recording material loading unit to the image forming unit; and a controller configured to perform control to change a position in which a user is prompted to check the transport state of the recording material, and to display a countermeasure method, based on a determination criterion that is determined according to (i) the transport state of the recording material detected by the detector and (ii) recording material information on the recording material.

BRIEF DESCRIPTION OF THE DRAWINGS

Exemplary embodiment(s) of the present disclosure will be described in detail based on the following figures, wherein:

FIG. 5A is a diagram illustrating an example of sheet-width-based priorities for calculating a skew determination threshold;

FIG. 5B is a diagram illustrating an example of sheet-type-based priorities;

FIG. 5C is a diagram illustrating an example of detection determination levels based on a combination of the sheet-width-based priorities of the sheet-type-based priorities;

FIG. 6 is a diagram illustrating an example of skew detection determination levels based on a combination of sheet sizes and sheet types;

DETAILED DESCRIPTION

The present disclosure will be described in more detail by way of the following exemplary embodiments and specific examples with reference to the accompanying drawings. However, the present disclosure is not limited to these exemplary embodiments and specific examples.

It should be noted that in the following description using the drawings, the drawings are schematic and ratios of dimensions and the like are different from actual ones.

Illustration of members other than those necessary for the description is omitted as appropriate for the sake of easy understanding.

Figure 1:
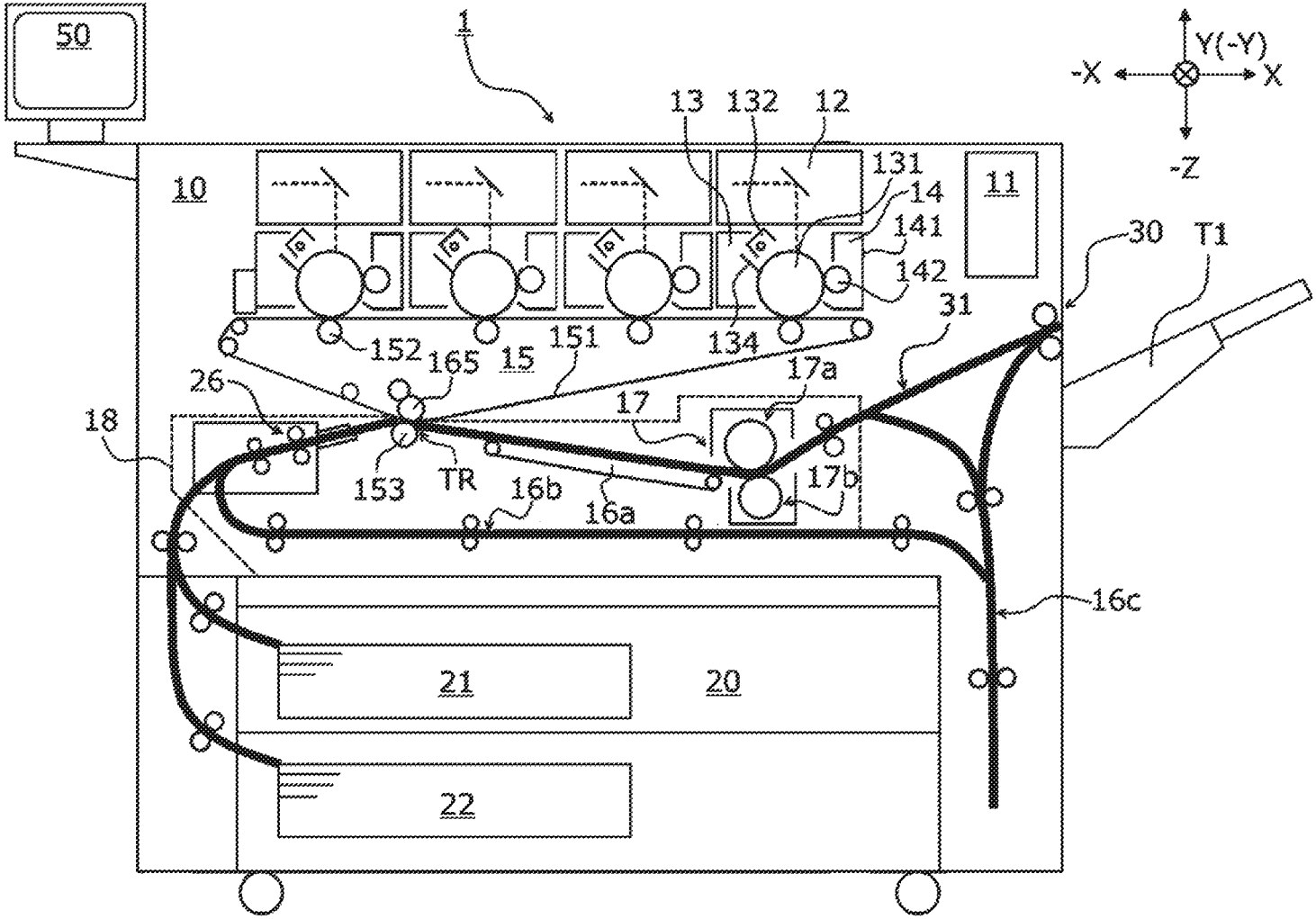
FIG. 1 is a schematic sectional diagram illustrating an internal configuration of an image forming apparatus.

(1) Entire Configuration and Operation of Image Forming Apparatus (1.1) Entire Configuration of Image Forming Apparatus FIG. 1 is a schematic sectional diagram showing an example of a schematic configuration of an image forming apparatus 1 according to the present exemplary embodiment.

The image forming apparatus 1 includes an image forming unit 10, a sheet feeding device 20 that is attached to a lower part of the image forming unit 10, a sheet discharge unit 30 that is provided on one end of the image forming unit 10 and to which a printed sheet P is discharged, an image processing unit 40 (see FIG. 2) that generates image information from printing information transmitted from an upper-level device, and an operation information unit 50.

The image forming unit 10 includes a system control device 11 (particularly see FIG. 2), exposure devices 12, photoconductor units 13, developing devices 14, a transfer device 15, a sheet transport device 16*a*, and a fixing device 17. The image forming unit 10 forms the image information received from the image processing unit 40 on the sheet P fed from the sheet feeding device 20 as a toner image.

The sheet feeding device 20 includes sheet trays 21 and 22 which are examples of a recording material loading unit. The sheet feeding device 20 is provided on a bottom part of the image forming unit 10 and supplies sheets to the image forming unit 10. That is, the sheet feeding device 20 includes the plural sheet trays 21 and 22 that accommodate the sheets P (serving as recording materials) of different types (for example, material, thickness, sheet size, and sheet texture). The sheet feeding device 20 is configured to supply the sheets P fed from any one of the plural sheet trays 21 and 22 to the image forming unit 10. The sheet trays 21 and 22 can be drawn out to an operator side (−Y direction), and are drawn out to the operator side to supply the sheets P.

The sheet discharge unit 30 discharges the sheet P to which an image is output by the image forming unit 10 and to which the image is fixed by the fixing device 17. For this purpose, the sheet discharge unit 30 includes a transport path 31 that transports the sheet P after fixing and a discharged sheet accommodating unit T1 to which the sheet P is discharged. When images are output on both sides of the sheet P, the sheet discharge unit 30 includes a sheet transport device 16*c* that inverts the sheet P and feeds the inverted sheet P to a sheet transport device 16*b*. The sheet discharge unit 30 may have a function of performing post-processing such as cutting or stapling (needle binding) on a sheet bundle output from the image forming unit 10.

A drawer unit 18 (indicated by a broken line in FIG. 1) is provided on a lower part of the image forming unit 10 in such a manner that the drawer unit 18 can be drawn out from an image forming apparatus main body.

The drawer unit 18 accommodates a registration roller pair 26 that aligns and feeds the sheet P toward the transfer device 15, a secondary transfer unit TR that secondarily transfers a toner image on an intermediate transfer belt 151 onto the sheet P, the sheet transport device 16*a* that transports the sheet P toward the fixing device 17, the sheet transport device 16*b* that transports the sheet P inverted for duplex printing toward the registration roller pair 26, the fixing device 17 and the like. When the drawer unit 18 is drawn out to the operator side, a paper jam during image formation can be dealt with.

The operation information unit 50 is used for inputting various settings and instructions, and for displaying information. That is, the operation information unit 50 corresponds to a so-called user interface. Specifically, the operation information unit 50 is implemented by a combination of a liquid crystal display panel, various operation buttons, a touch panel and the like.

(1.2) Configuration and Operation of Image Forming Unit

In the image forming apparatus 1 having such a configuration, the sheet P which is fed out from a recording material loading unit designated by a printing job for each sheet among the sheet feeding device 20 is fed to the image forming unit 10 according to a timing of the image formation.

The photoconductor units 13 are provided in parallel with each other below the exposure devices 12. Each of the photoconductor units 13 includes a photoconductor drum 131 that serves as image carrier and that is driven to rotate. A charger 132, the exposure device 12, the developing device 14, a primary transfer roller 152, and a cleaning blade 134 are arranged along a rotation direction of each of the photoconductor drums 131.

The developing device 14 includes a developing housing 141 that accommodates a developer. In the developing housing 141, a developing roller 142 is disposed to face the photoconductor drum 131.

The developing devices 14 are substantially the same as each other, except for the developers respectively accommodated in the developing housings 141. The developing devices 14 form toner images of yellow (Y), magenta (M), cyan (C), and black (K), respectively.

A surface of the rotatable photoconductor drum 131 is charged by the charger 132. An electrostatic latent image is formed by latent image forming light emitted from the exposure device 12. The electrostatic latent image formed on the photoconductor drum 131 is developed into a toner image by the developing roller 142.

The transfer device 15 includes the intermediate transfer belt 151 on which the toner images of the respective colors formed on the respective photoconductor drums 131 of the respective photoconductor units 13 are transferred in a superimposed manner, the primary transfer rollers 152 that sequentially transfer (primarily transfer) the toner images of the respective colors formed on the respective photoconductor units 13 onto the intermediate transfer belt 151, and a secondary transfer roller 153 that collectively transfers (secondarily transfers) the toner images of the respective colors, which are transferred onto and superimposed on the intermediate transfer belt 151, onto the sheet P serving as a recording medium.

At primary transfer units where the intermediate transfer belt 151 and the respective photoconductor drums 131 are in contact with each other, the toner images of the respective colors formed on the respective photoconductor drums 131 of the respective photoconductor units 13 are sequentially electrostatically transferred (primarily transferred) onto the intermediate transfer belt 151 by the primary transfer rollers 152 to which a predetermined primary transfer voltage is applied from a power supply device (not illustrated) controlled by the system control device 11, and a superimposed toner image in which the toner images of the respective colors are superimposed is formed on the intermediate transfer belt 151.

As the intermediate transfer belt 151 moves, the superimposed toner image on the intermediate transfer belt 151 is transported to the secondary transfer unit TR in which the secondary transfer roller 153 is in pressure contact with a backup roller 165 via the intermediate transfer belt 151.

When the superimposed toner image is transported to the secondary transfer unit TR, the sheet P is supplied from the sheet feeding device 20 to the secondary transfer unit TR according to a timing of the transport of the superimposed toner image. A predetermined secondary transfer voltage is applied from the power supply device (not illustrated) controlled by the system control device 11 to the backup roller 165 facing the secondary transfer roller 153 via the intermediate transfer belt 151, and multiple toner images on the intermediate transfer belt 151 are collectively transferred onto the sheet P.

The toner remaining on the surface of the photoconductor drum 131 is removed by the cleaning blade 134. Then, the surface of the photoconductor drum 131 is re-charged by the charger 132.

The sheet P onto which the toner images are transferred by the transfer device 15 is transported to the fixing device 17 via the sheet transport device 16*a* in a state where the toner images are not fixed. The toner images are fixed to the sheet P transported to the fixing device 17 by the action of heating and pressurizing by a pair of heating module 17*a* and pressure module 17*b*.

The sheet P after fixing is loaded on the discharged sheet accommodating unit T1. When images are output on both sides of the sheet P, the sheet P are inverted by the sheet transport device 16*c*, and is fed again to the secondary transfer unit TR in the image forming unit 10. After the toner images are transferred to the sheet P and the transferred toner images are fixed to the sheet P, the sheet P is fed to the sheet discharge unit 30. The sheet P fed to the sheet discharge unit 30 is subjected to post-processing such as cutting or stapling (needle binding) as necessary.

Figure 2:
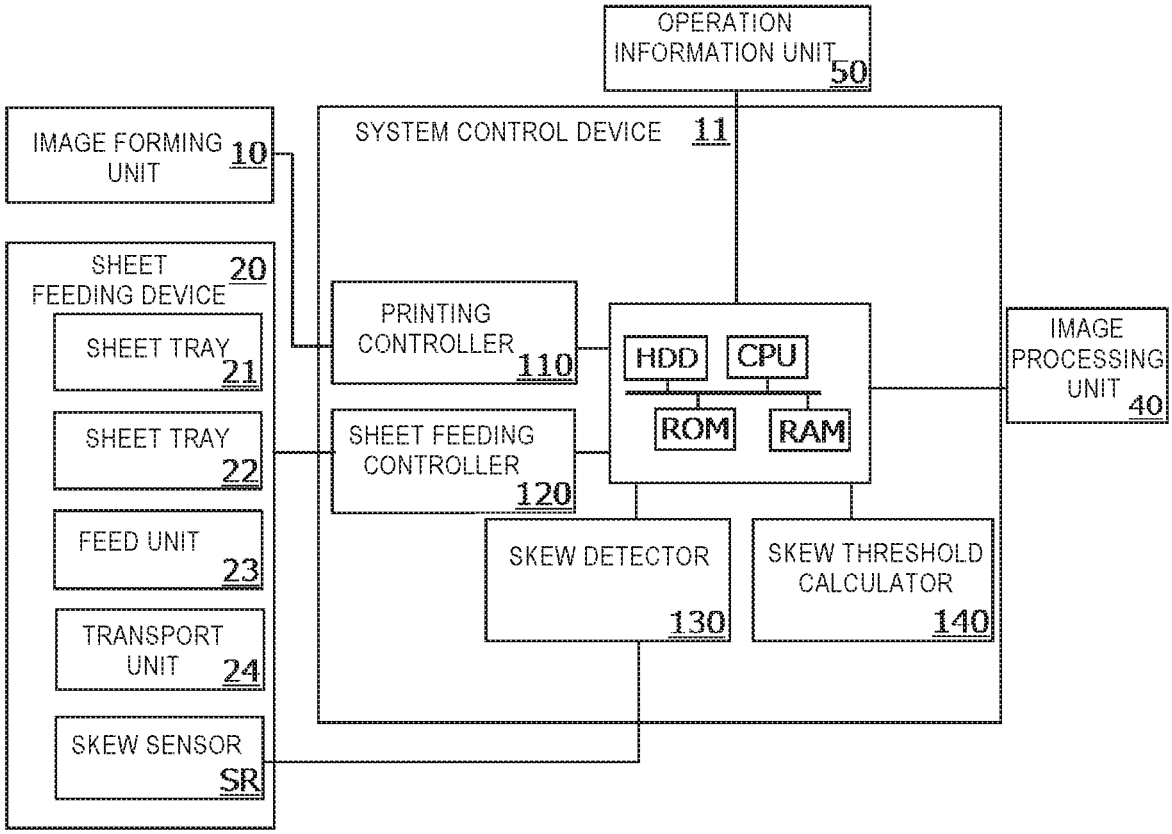
FIG. 2 is a functional block diagram illustrating a functional configuration of the image forming apparatus.
Figure 3:
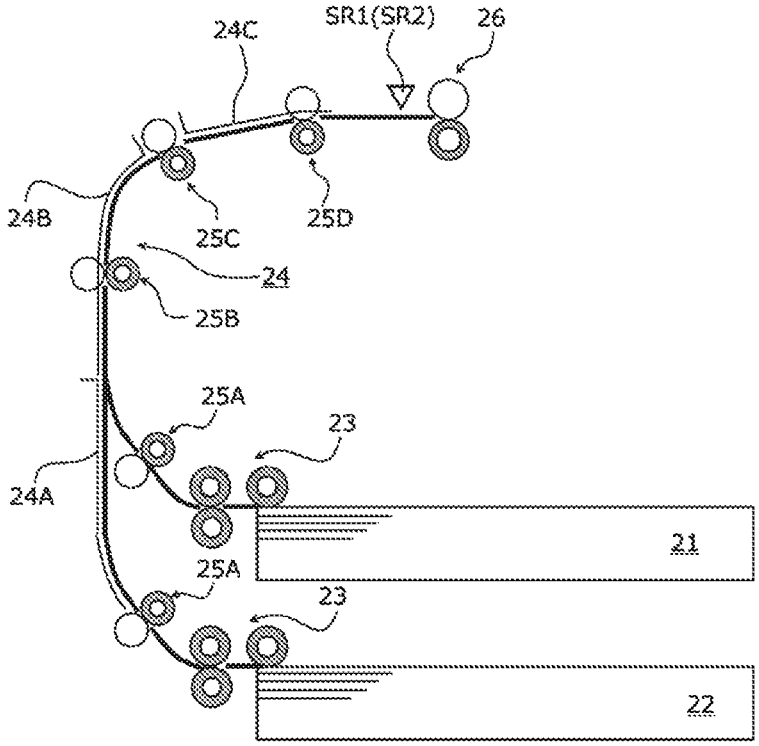
FIG. 3 is a diagram illustrating a functional configuration of a sheet feeding device.
Figure 4:
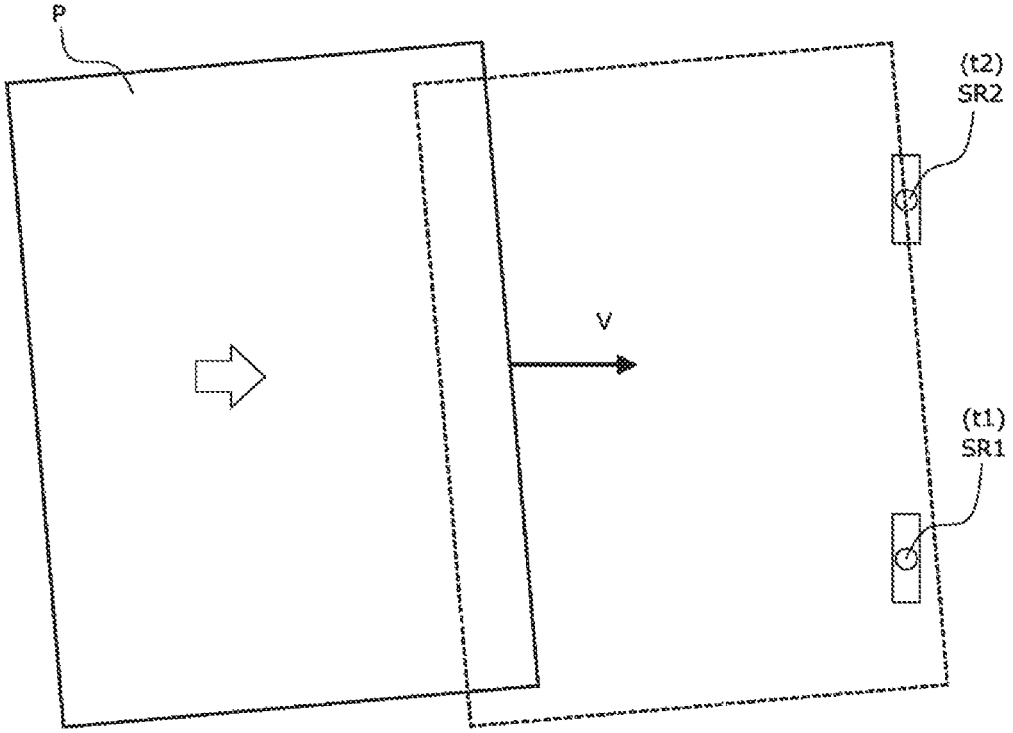
FIG. 4 is a diagram illustrating skew detection.

(2) Functional Configuration and Operation of Image Forming Apparatus (2.1) Functional Configuration of System Control Device FIG. 2 is a functional block diagram illustrating a functional configuration of the image forming apparatus 1 according to the present exemplary embodiment. FIG. 3 is a diagram illustrating a functional configuration of the sheet feeding device 20. FIG. 4 is a diagram illustrating skew detection. FIG. 5A is a diagram illustrating an example of sheet-width-based priorities for calculating a skew determination threshold (Th). FIG. 59 is a diagram illustrating an example of sheet-type-based priorities. FIG. 5C is a diagram illustrating an example of detection determination levels based on a combination of the sheet-width-based priorities and the sheet-type-based priorities. FIG. 6 is a diagram illustrating an example of skew detection determination levels based on a combination of sheet sizes and sheet types.

The functional configuration and operation of the image forming apparatus 1 will be described below with reference to the accompanying drawings.

The image forming apparatus 1 includes the system control device 11 including a printing controller 110, a sheet feeding controller 120, a skew detector 130, and a skew threshold calculator 140. The system control device 11 executes a control program stored in a memory to control the overall operation of the image forming apparatus 1.

In addition to controlling exchange of information with the sheet feeding device 20, the printing controller 110 gives operation control instructions to the exposure device 12, the photoconductor unit 13, the developing device 14, the transfer device 15, the sheet transport device 16*a*, the fixing device 17 and the like that are provided in the image forming unit 10.

The sheet feeding controller 120 gives operation control instructions to the sheet trays 21 and 22, feed units 23, a transport unit 24 and the like based on a sheet size and a sheet type of the sheet P which serves as a recording material and which is designated by the printing job.

The skew detector 130 is an example of a detector configured to detect a transport state of the sheet P. The skew detector 130 obtains a signal from skew sensor SR that detects a skew state of the sheet P fed toward the image forming unit 10 during the image formation and calculate a deviation amount of a leading end of the sheet P being transported with respect to a transport direction of the sheet P under predetermined conditions.

The skew threshold calculator 140 calculates a skew determination threshold (Th) with respect to the deviation amount of the sheet P calculated by the skew detector 130, based on a skew detection determination level that is determined in advance for each combination of a size and a type of the sheet P.

The system control device 11 serves as a controller configured to perform control (a) to change a position in which a user of the image forming apparatus 1 is prompted to check the transport state of the sheet P and (b) to cause the operation information unit 50 to display a countermeasure method, based on the skew determination threshold (Th) calculated by the skew threshold calculator 140.

(2.2) Sheet Transport and Skew Detection

As schematically illustrated in FIG. 3, the sheet feeding device 20 feeds the sheets P loaded on the sheet trays 21 and 22 toward the transport unit 24 while separating the sheets P one by one at the feed unit 23. The transport unit 24 is an example of a transport unit. The transport unit 24 includes plural transport roller pairs 25.

The transport unit 24 is curved upward from the feed units 23. The transport unit 24 transports the sheet P fed from the feed unit 23 by the plural transport roller pairs 25 (25A, 25B, 25C, and 25D), toward the registration roller pair 26.

The transport unit 24 includes guide chutes 24A, 24B, and 24C that can be opened and closed with respect to the transport roller pairs 25A. 25B, 25C, and 25D. When the guide chutes 24A, 24B, and 24C are open, the inside of the transport unit 24 and the transport roller pairs 25A, 253, 25C, and 25D are exposed.

The skew sensor SR that detects the leading end of the sheet P that passes through is disposed downstream of the transport unit 24 in the sheet transport direction and upstream of the registration roller pair 26 in the sheet transport direction. The skew sensor SR is a reflection optical sensor including a light emitter and a light receiver. As illustrated in FIG. 4, plural skew sensors SR (two skew sensors SR in the present exemplary embodiment) are arranged at predetermined intervals in a sheet width direction intersecting (orthogonal to) the sheet transport direction. Alternatively, depending on a size of the sheet P that can be transported in the image forming apparatus 1, plural skew sensors SR, for example, three skew sensors SR may be arranged in the sheet width direction.

The skew detector 130 calculates a deviation amount X as skew of the sheet P based on a difference between a detection timing t1 when the leading end of the sheet P reaches a skew sensor SR1 and a detection timing t2 when the leading end of the sheet P reaches a skew sensor SR2.

Specifically, when a difference T between the detection timings is defined as $$T=t2-t1 \quad (1)$$

(normally, t1 is set to 0 msec as a reference), and when V denotes a transport speed of the sheet P, a deviation amount X is obtained by the following formula.

$$X\,(\text{mm})=T\times V \quad (2).$$

The skew threshold calculator 140 calculates the skew determination threshold (Th) for determining whether the sheet P is skewed, according to a predetermined combination of a priority that is ranked based on a size of sheet and a priority that is ranked based on a type of a sheet, with respect to the deviation amount X (mm) of the sheet P calculated by the skew detector 130.

FIG. 5A illustrates the example of the sheet-width-based priorities for calculating the skew determination threshold (Th). FIG. 5B illustrates the example of the sheet-type-based priorities. FIG. 5C illustrates the example of the detection determination levels based on the combination of the sheet-width-based priorities and the sheet-type-based priorities. These tables are stored in a ROM of the system control device 11. The respective priorities can be optionally changed after read out from the tables.

For example, when a sheet width is "257 mm to 297 mm (B4SEF to A3SEF; SEF is an abbreviation for short edge feed)", the priority is "1" and is set so that a detection level for determining skew is high (see FIG. 5A). When a sheet type is "plain paper", the priority is "1" and is set so that a detection level for determining skew is high (see FIG. 5B).

When the sheet-width-based priority is "1" and the sheet-type-based priority is "1", a detection level for determining skew is "A". Even when the deviation amount X due to the skew is small, the skew determination threshold (Th) for determining skew is a low value (see FIG. 5C).

FIG. 6 illustrates the example of the skew detection determination levels based on the combination of the sheet sizes and the sheet types. For example, when the sheet size is "210 mm or less (A4 SEF or less)" and the sheet type is "plain paper", the detection determination level is "A". Even when the deviation amount X due to the skew is small, the skew determination threshold (Th) for determining skew is a low value. Therefore, the skew is easily determined even when the deviation amount is not large. When the sheet size is also "21.0 mm or less (A4 SEF or less)" and the sheet type is "coated paper", the detection determination threshold level is "C". When the deviation amount X due to the skew is large, the skew determination threshold (Th) is a high value. Therefore, the skew is unlikely to be determined even when the deviation amount due to the skew is large.

(3) Skew Detection and Countermeasure Display

Figure 7:
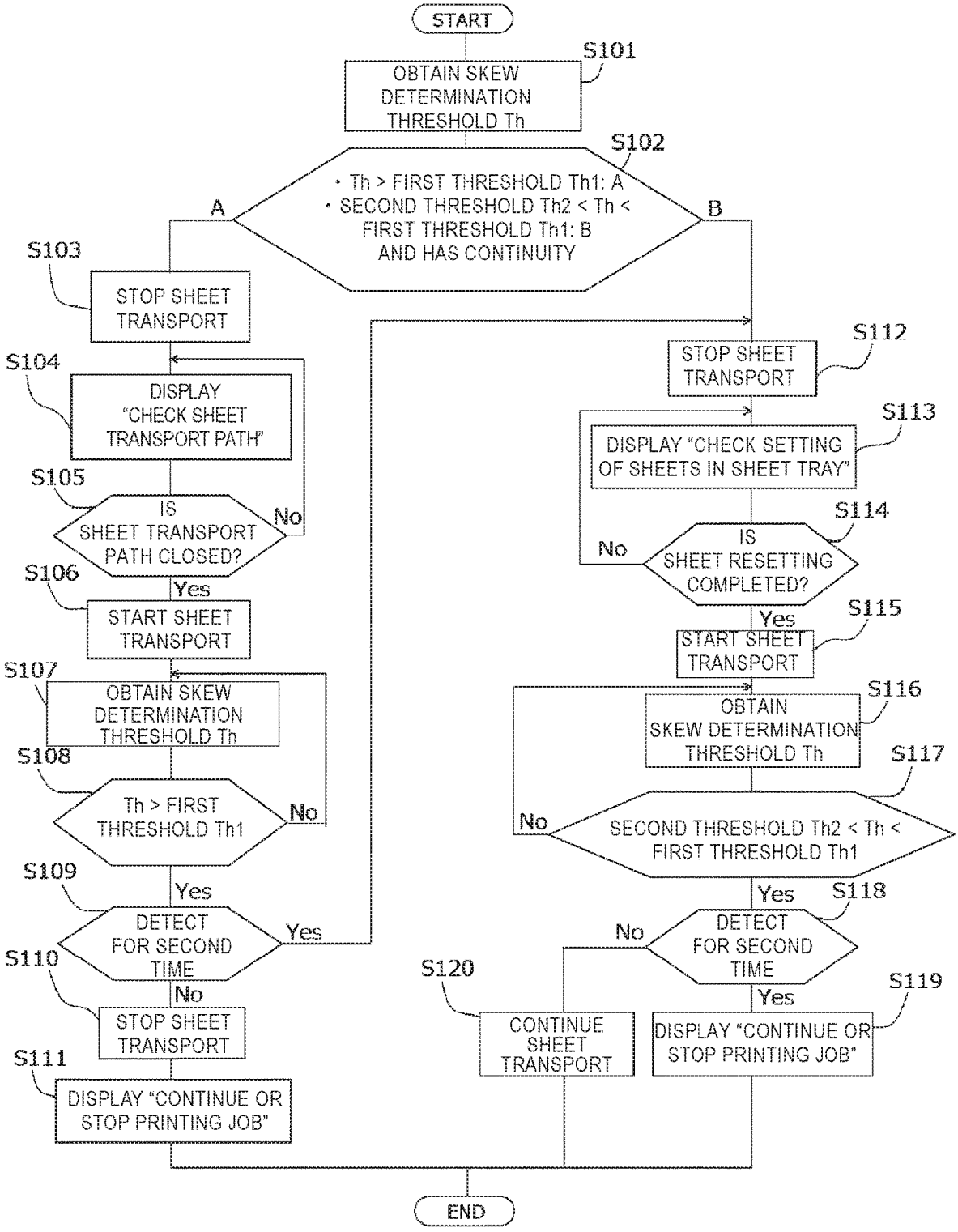
FIG. 7 is a flowchart illustrating an operation flow during skew determination.
Figure 8A:
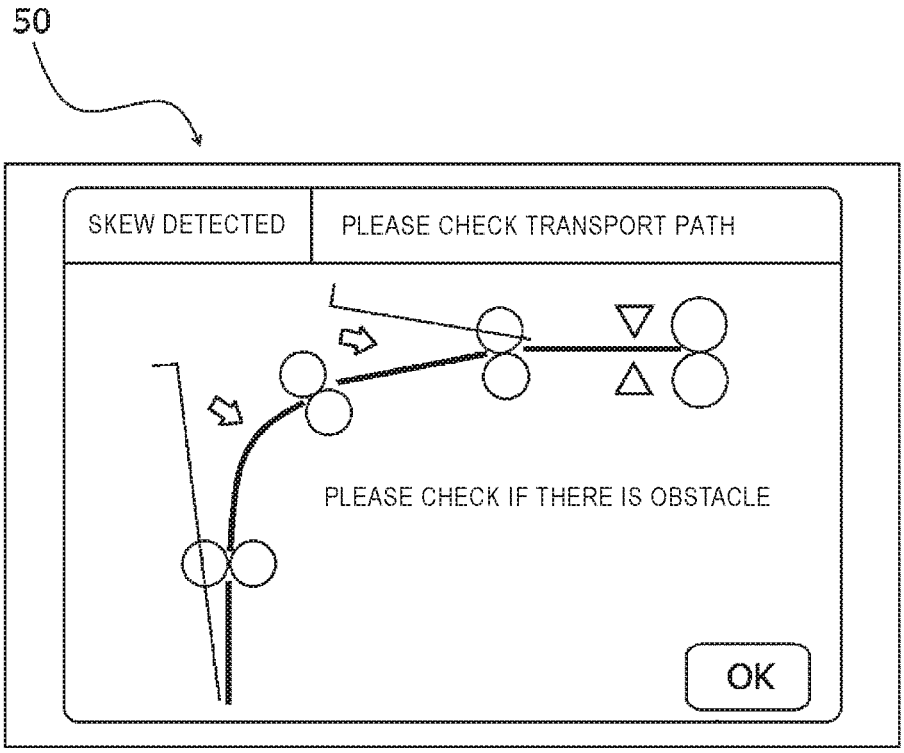
FIGS. 8A and 8B are diagrams illustrating display examples on an operation information unit to prompt a user to take countermeasures for a transport path.
Figure 8B:
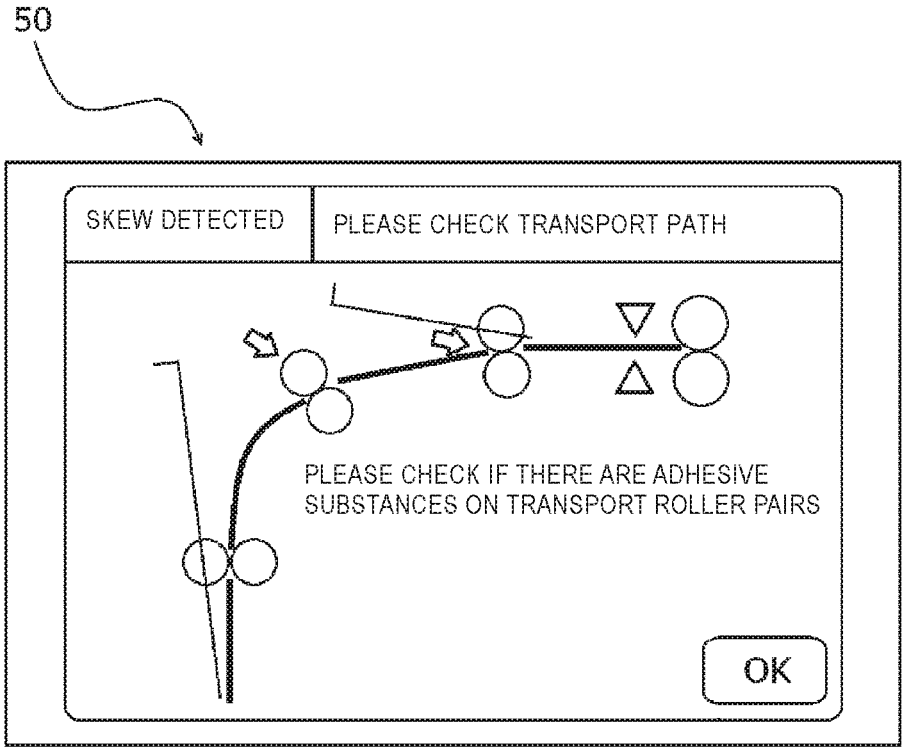
Figure 9A:
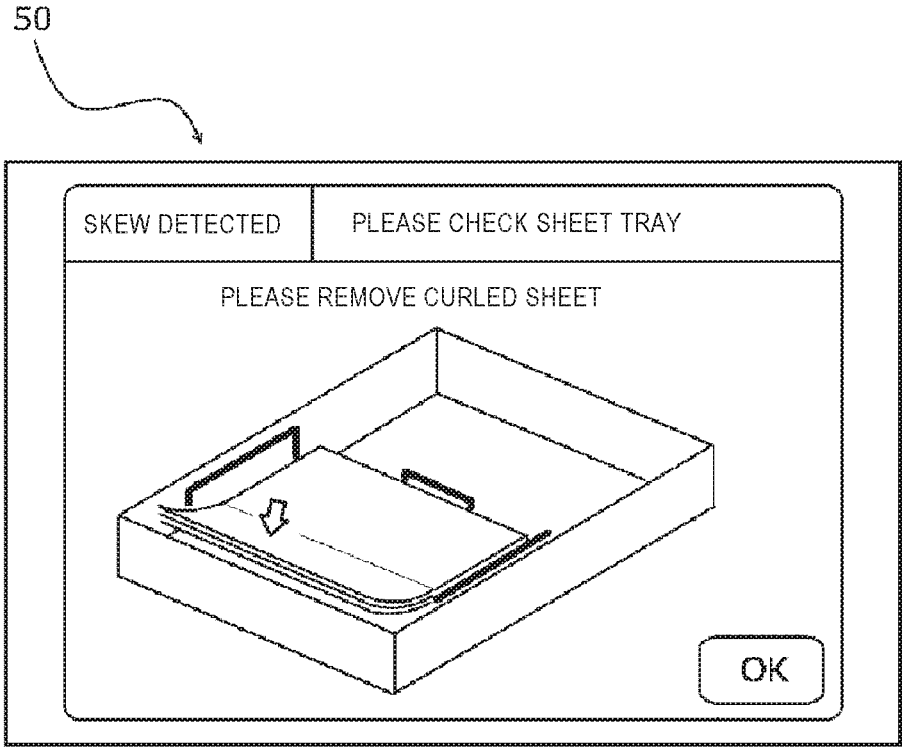
FIGS. 9A and 9B are diagrams illustrating display examples on the operation information unit to prompt the user to take countermeasures for a sheet tray.
Figure 9B:
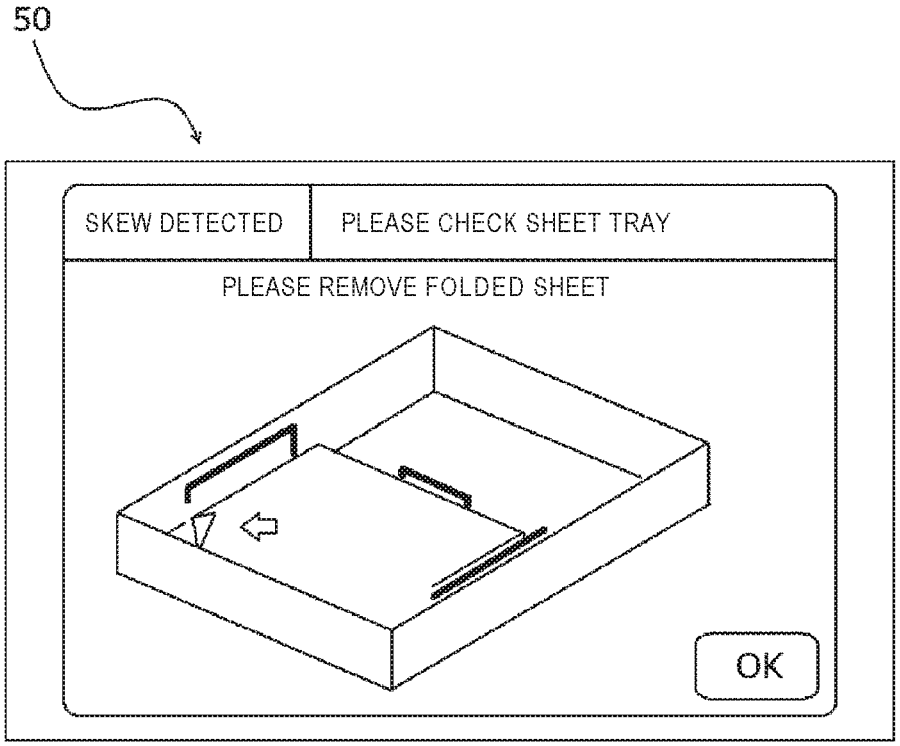
Figure 10A:
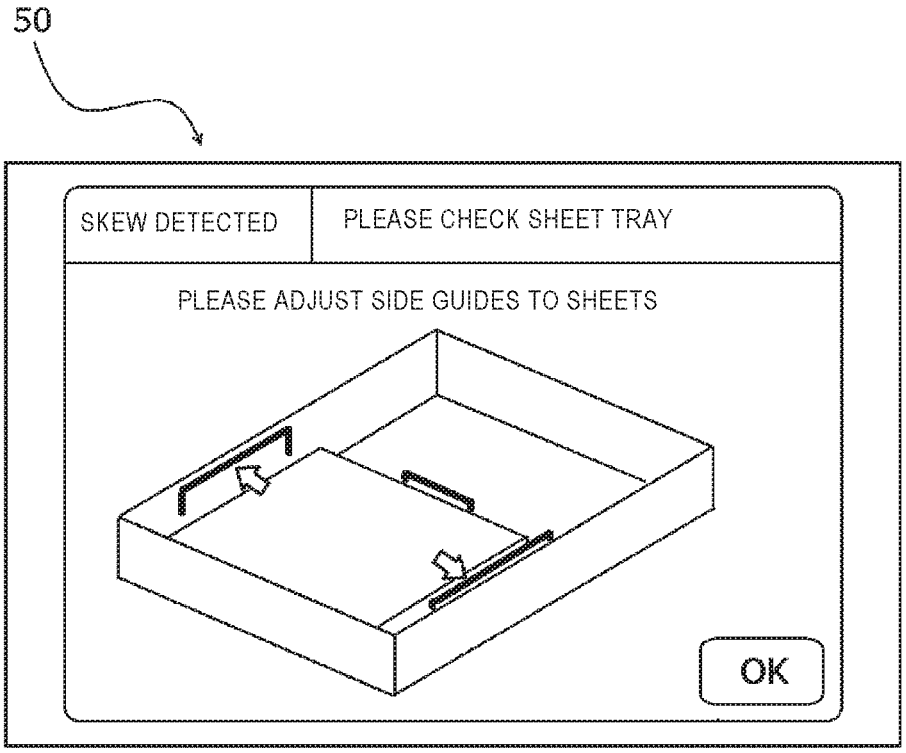
FIGS. 10A and 10B are diagrams illustrating display examples on the operation information unit to prompt the user to take other countermeasures for the sheet tray.
Figure 10B:
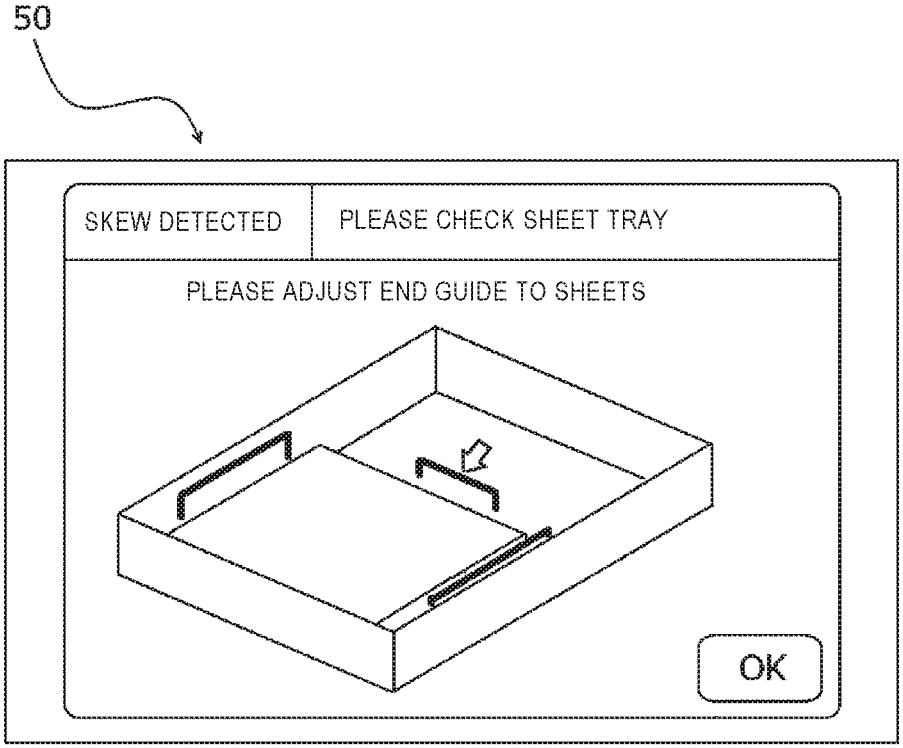
Figure 11:
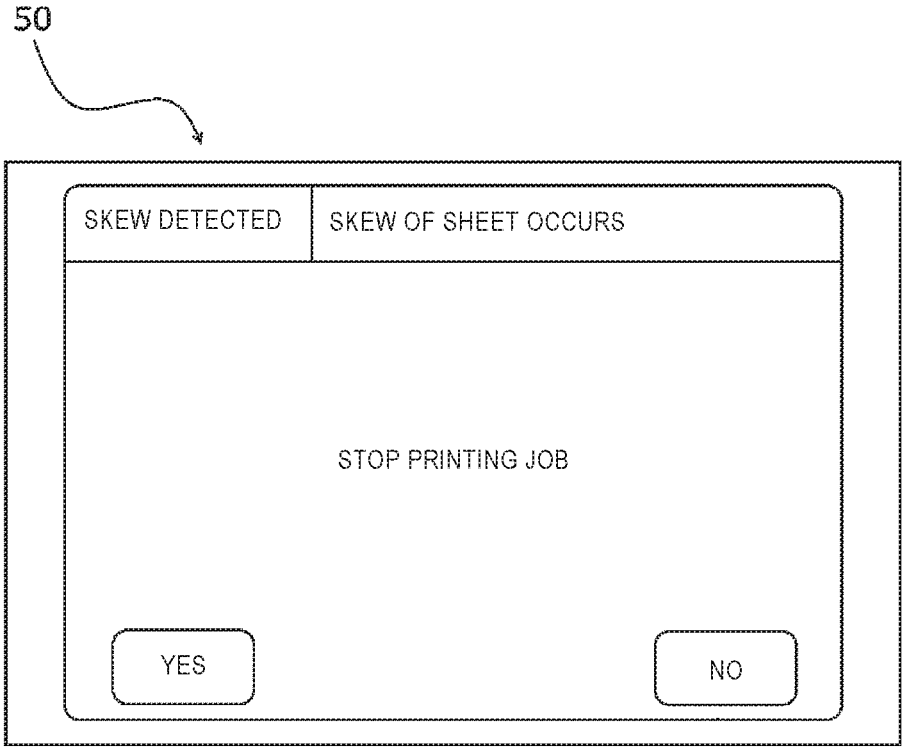
FIG. 11 is a diagram illustrating a display example on the operation information unit to prompt the user to select continuation or interruption of a printing job.

FIG. 7 is a flowchart illustrating an operation flow during skew determination. FIGS. 8A and 8B are diagrams illustrating display examples on the operation information unit 50 for prompting the user to take countermeasures for the transport unit 24. FIGS. 9A and 9B are diagrams illustrating display examples on the operation information unit 50 for prompting the user to take countermeasures for the sheet trays 21 and 22. FIGS. 10A and 10B are diagrams illustrating display examples on the operation information unit 50 for prompting the user to take other countermeasures for the sheet trays 21 and 22. FIG. 11 is a diagram illustrating a display example on the operation information unit 50 for prompting the user to select continuation or interruption of the printing job.

The operation flow of the skew detection in the image forming apparatus 1 will be described below with reference to the accompanying drawings.

The system control device 11 is an example of the controller. The system control device 11 performs control (a) to change a position in which the user is prompted to check the transport state of the sheet P and (b) to display a countermeasure method, based on the skew determination threshold (Th) that is determined according to (i) the deviation amount indicating the transport state of the sheet P detected by the skew detector 130 serving as the detector and (ii) the sheet size and sheet type of the sheet P.

Specifically, first, the skew determination threshold (Th) is obtained (S101). The skew determination threshold (Th) is calculated with respect to the deviation amount X (mm) detected by the skew sensor SR as described above, based on the skew detection determination level (A, B, or C) that is determined in advance for each combination of a size and type of the sheet P.

Then, when the skew determination threshold (Th) exceeds a predetermined first threshold (Th1) (S102: A), the system control device 11 stops the sheet transport (S103), and causes the operation information unit 50 to display information that prompts the user to check a sheet transport path (S104). Here, as the information that prompts the user to check the sheet transport path, the operation information unit 50 is caused to display animation images of the transport unit 24 and check instructions as illustrated in FIGS. 8A and 8B. FIG. 8A illustrates an example of checking the presence or absence of an obstacle in the transport unit 24. FIG. 8B illustrates an example of checking the presence or absence of adhesive substances such as dirt or paper dust on the transport roller pairs 25.

Accordingly, when a detected skew degree is large (the skew determination threshold (Th) exceeds the first threshold (Th1)), the information that prompts the user to check the transport unit 24 (an example of the transport unit) as a first check position. Thereby, it is possible to accurately and promptly notify the user of an assumed malfunction.

When the user terminates the check on the transport unit 24, and closing of the sheet transport path is detected (S105: Yes), the sheet transport is started (S106). Then, the skew determination threshold (Th) is obtained again (S107). When the skew determination threshold (Th) exceeds the predetermined first threshold (Th1) (S108: Yes), it is determined whether the skew is detected for a second time (S109). When it is determined that the skew is detected for the second time (S109: Yes), the sheet transport is stopped (S112), and the operation information unit 50 is caused to display information that prompts the user to check setting of sheets in the sheet trays 21 and 22 (S113).

That is, it is assumed that there is no cause of skew in the previously checked transport unit 24, and the user is prompted to check the sheet trays 21 and 22 upstream of the transport unit 24 in the sheet transport direction.

When it is determined in step S109 that the skew is detected for a third time or a subsequent time (S109: No), the sheet transport is stopped (S110) and the operation information unit 50 is caused to display information that allows the user to select whether to continue or stop the printing job (S111) as illustrated in FIG. 11. Accordingly, the user can select whether to continue or stop the printing job even when the skew occurs.

In step S102, when the skew determination threshold (Th) does not exceed the predetermined first threshold (Th1), and continues to exceed a second threshold (Th2) different from the first threshold (Th1) (S102: B), the system control device 11 stops the sheet transport (S112) and display information that prompts the user to check setting of sheets in the sheet trays 21 and 22 (S113).

Here, as the information that prompts the user to check the settings of the paper in the sheet trays 21 and 22, the operation information unit 50 is caused to display animation images of the sheet tray 21 (22) and check instructions as illustrated in FIGS. 9A to 10B. FIG. 9A illustrates an example of checking whether the sheets P in the sheet tray 21 (22) are curled (curved). FIG. 9B illustrates an example of checking whether the sheets P are folded. FIG. 10A illustrates an example of checking whether side guides are adjusted to the sheets P accommodated in the sheet tray 21 (22). FIG. 10B illustrates an example of checking whether an end guide is adjusted to the accommodated sheets P.

As described above, when the predetermined skew degree is continuously detected even though the detected skew degree is not large, the information that prompts the user to check the sheet trays 21 and 22 as first check positions is displayed. Thereby, it is possible to accurately and promptly notify the user of an assumed malfunction.

When the user terminates the checks on the sheet trays 21 and 22 (S114: Yes), the sheet transport is started (S115). Then, the skew determination threshold (Th) is obtained again (S116). When the skew determination threshold (Th) does not exceed the first threshold (Th1) and exceeds the second threshold (Th2) (S117: Yes), it is determined whether the skew is detected for the second time (S118). When it is determined that the skew is detected the second time (S118: Yes), the operation information unit 50 is caused to display information that allows the user to select whether to continue or stop the printing job (see S119, FIG. 11). When it is determined that the skew is detected for the third time or a subsequent time (S118: No), the sheet transport is continued (S120).

That is, when the predetermined skew degree is continuously detected after a countermeasure is taken even though the detected skew degree is not large, the information that allows the user to select whether to continue the transport is displayed. Thereby, it is possible to accurately and promptly notify the user of an assumed malfunction.

Accordingly, a position in which the user is prompted to check the transport state of the sheet P is changed and a countermeasure method is displayed, based on the skew determination threshold (Th) that is determined according to (i) the deviation amount indicating the transport state of the sheet P detected by the skew detector 130 and (ii) the sheet size and sheet type of the sheet P. Thereby, it is possible to notify the user of an occurrence position of an assumed malfunction and to prompt the user to take a countermeasure, according to the detected skew degree and the continuity of the skew.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a recording material loading unit configured to load a recording material;

a transport unit configured to transport the recording material from the recording material loading unit to an image forming unit configured to form an image on the recording material;

a detector configured to detect a transport state of the transported recording material on a way from the recording material loading unit to the image forming unit; and a controller configured to:

change a position at which a user is prompted to check the transport state of the recording material; and to display a countermeasure method, using a determination criterion for determining the countermeasure method, wherein the determination criterion is determined according to (i) the transport state of the recording material detected by the detector and (ii) recording material information about the recording material, wherein the recording material information comprises information about a sheet size of the recording material and information about a sheet type of the recording material, wherein the determination criterion includes a first threshold and a second threshold different from the first threshold, wherein the image forming apparatus is configured such that, if the determination criterion exceeds the first threshold, then the transporting of the recording material is stopped and an animation image of the transport unit is displayed showing the position at which the user is prompted to check the transport state of the recording material, and wherein the image forming apparatus is configured such that, if the determination criterion exceeds the first threshold after the user has taken a countermeasure, then the transporting of the recording material is stopped, and an animation image of a sheet tray of the recording material loading unit is displayed showing the position at which the user is prompted to check the transport state of the recording material.

2. The image forming apparatus according to claim 1, wherein the image forming apparatus is configured such that, if the determination criterion does not exceed the first threshold and continues to exceed the second threshold, then the transporting of the recording material is stopped, and the recording material loading unit is displayed as the position at which the user is prompted to check the transport state of the recording material.

3. The image forming apparatus according to claim 2, wherein the image forming apparatus is configured such that, if the determination criterion continues to exceed the second threshold after the user has taken a countermeasure, then the transporting of the recording material is stopped, and information that allows the user to select whether to continue the transporting of the recording material is displayed.

4. The image forming apparatus according to claim 1, wherein the image forming apparatus is configured such that the first threshold and the second threshold are changed according to a size and a type of the recording material.

5. The image forming apparatus according to claim 1, wherein the detector comprises plural detectors, wherein the detectors are arranged along a direction that intersects with a transport direction of the recording material, wherein the detectors are disposed at downstream position in the transport direction of the recording material, and wherein the detectors are configured to detect the transport state using (i) a difference between timings at which an end of the recording material being transported is detected and (ii) a skew amount of the recording material calculated using a transport speed.

6. The image forming apparatus according to claim 1, wherein the recording material information comprises information about a thickness of the recording material.

7. The image forming apparatus according to claim 1, wherein the recording material information comprises information about a sheet texture of the recording material.

8. The image forming apparatus according to claim 1, wherein the recording material information comprises information about whether or not the recording material is label paper.

9. The image forming apparatus according to claim 1, wherein the recording material information comprises information about whether or not the recording material is coated paper.

10. An image forming apparatus comprising:

a recording material loading means at which a recording material is loaded;

a transport means for transporting the recording material from the recording material loading means to image forming means for forming an image on the recording material;

a means for detecting a transport state of the transported recording material on a way from the recording material loading means to the image forming means; and a means for performing control to:

change a position at which a user is prompted to check the transport state of the recording material; and to display a countermeasure method, using a determination criterion for determining the countermeasure method, wherein the determination criterion is determined according to (i) the detected transport state of the recording material and (ii) recording material information about the recording material, wherein the recording material information comprises information about a sheet size of the recording material and information about a sheet type of the recording material, wherein the determination criterion includes a first threshold and a second threshold different from the first threshold, wherein the image forming apparatus is configured such that, if the determination criterion exceeds the first threshold, then the transporting of the recording material is stopped and an animation image of the transport means is displayed showing the position at which the user is prompted to check the transport state of the recording material, and wherein the image forming apparatus is configured such that, if the determination criterion exceeds the first threshold after the user has taken a countermeasure, then the transporting of the recording material is stopped, and an animation image of a sheet tray of the recording material loading means is displayed showing the position at which the user is prompted to check the transport state of the recording material.

* * * * *